US007597071B1

(12) United States Patent
Hirs

(10) Patent No.: US 7,597,071 B1
(45) Date of Patent: Oct. 6, 2009

(54) APPARATUS AND METHOD FOR ESTABLISHING DUAL COMPRESSION RATIOS WITHIN AN INTERNAL COMBUSTION ENGINE TO IMPROVE MILEAGE

(76) Inventor: Gene Hirs, 340 Orange Tree Dr., Unit 5, Atlantis, FL (US) 33462-1339

( * ) Notice: Subject to any disclaimer, the term of this patent is extended or adjusted under 35 U.S.C. 154(b) by 0 days.

(21) Appl. No.: 12/136,243

(22) Filed: Jun. 10, 2008

(51) Int. Cl.
*F02B 75/04* (2006.01)
*F02B 75/32* (2006.01)

(52) U.S. Cl. ..... 123/78 E; 123/25 A; 123/25 C; 123/25 K; 123/182.1

(58) Field of Classification Search ..... 123/78 R, 123/78 E, 25 A, 25 C, 25 K, 182.1
See application file for complete search history.

(56) References Cited

U.S. PATENT DOCUMENTS 3,861,239 A * 1/1975 McWhorter ..... 74/602
5,909,720 A * 6/1999 Yamaoka et al. ..... 123/179.3
6,779,495 B2 * 8/2004 Yamada et al. ..... 123/78 E
7,334,547 B2 * 2/2008 Hiraya et al. ..... 123/48 R
7,506,620 B2 * 3/2009 Yasui ..... 123/48 R
2003/0209212 A1 * 11/2003 Yamada et al. ..... 123/48 B
2004/0211372 A1 * 10/2004 Shimazaki ..... 123/25 C
2004/0261733 A1 * 12/2004 Henig et al. ..... 123/78 E
2007/0209630 A1 * 9/2007 Hiraya et al. ..... 123/197.4
2008/0127931 A1 * 6/2008 Kuo ..... 123/25 C

* cited by examiner

*Primary Examiner*—Erick Solis
(74) *Attorney, Agent, or Firm*—Gifford, Krass, Sprinkle, Anderson & Citkowski, P.C.

(57) ABSTRACT

An apparatus and method for establishing two operating compression ratios in an internal combustion engine resulting in improved mileage and including the provision of a fuel additive vapor for reducing a required temperature for compression.

7 Claims, 2 Drawing Sheets

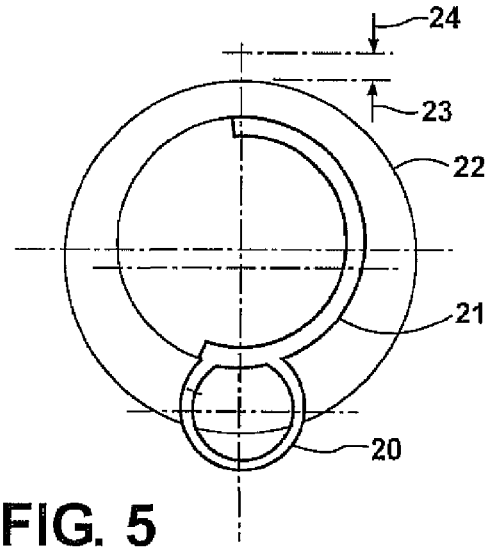
FIG. 5
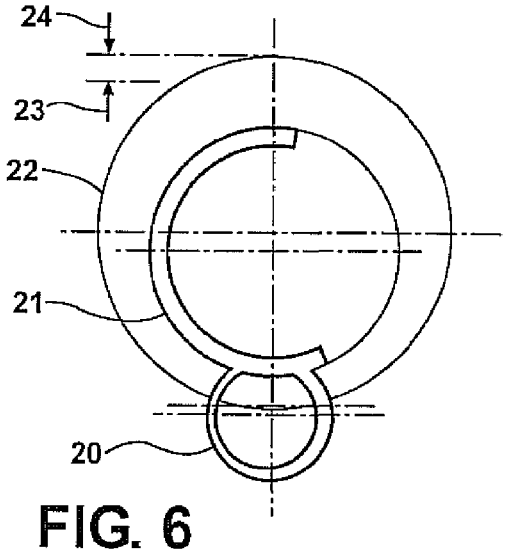
FIG. 6
FIG. 7
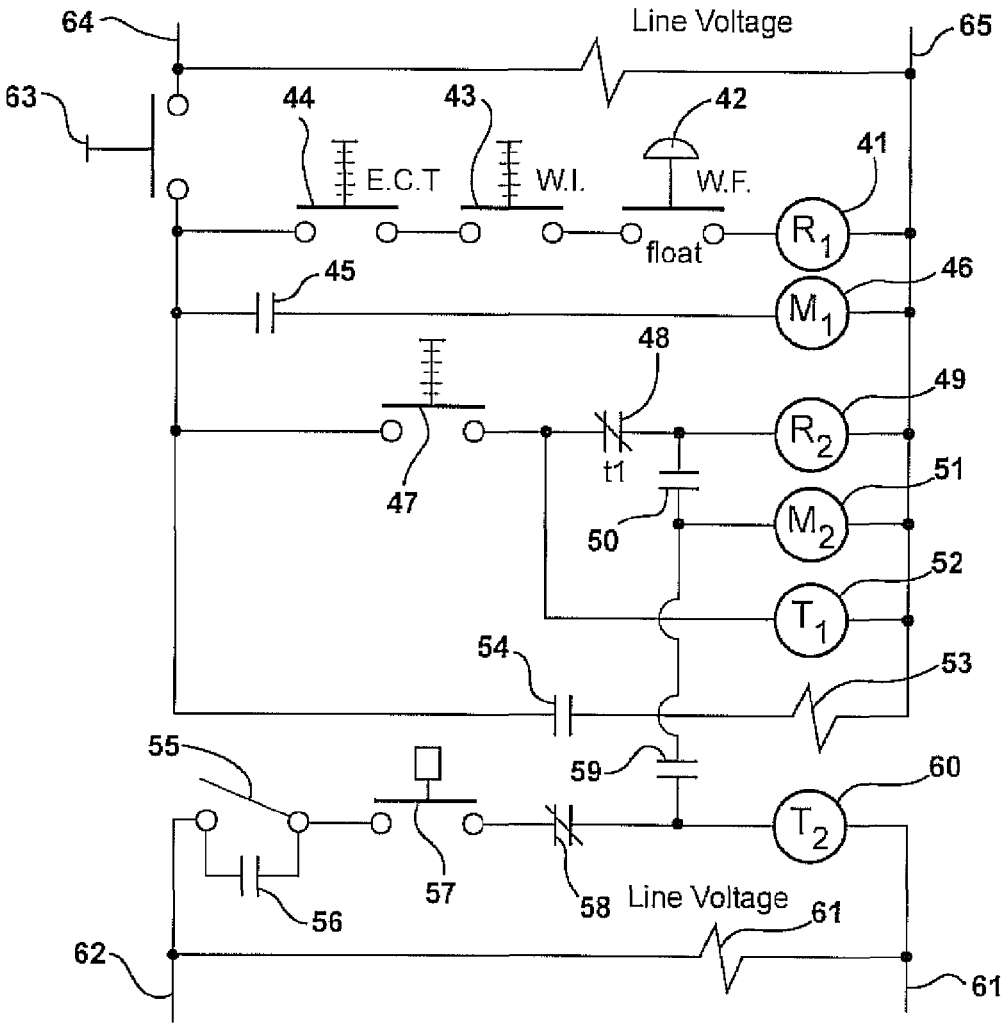

APPARATUS AND METHOD FOR ESTABLISHING DUAL COMPRESSION RATIOS WITHIN AN INTERNAL COMBUSTION ENGINE TO IMPROVE MILEAGE

FIELD OF THE INVENTION

The present invention pertains to a modified application of a four stroke Otto cycle engine. More specifically, the present invention discloses an apparatus and method for having a standard compression with a cold engine and shifting to a higher compression as the engine heats up.

BACKGROUND OF THE INVENTION

The Otto cycle engine principle is employed in internal combustion engine operations and which consists of 1) intake/induction stroke, 2) compression stroke, 3) power stroke and 4) exhaust stroke. The efficiency of this type of engine is determined by its compression ratio. The highest compression ratio is limited by the type of fuel (such as unleaded octane rated gasoline alone or with ethanol). Standard octane rated gasoline exhibits a low ignition temperature, this resulting in limited compression during the ignition cycle.

As is known in gasoline engines utilizing the Otto cycle, air is drawn into each cylinder during downward travel of its associated piston. Subsequent upward travel of the piston compresses the air, however the temperature of compression cannot be so high that pre-ignition occurs in the combustion chamber and the fuel air mixture to explode.

SUMMARY OF THE INVENTION

The object of the present invention is to increase the efficiency of the Otto cycle engine by improving mileage in a vehicle by having a low starting compression ratio and higher ratio when the engine is heated up. To reduce the heat of compression and thereby preventing pre-ignition a water spray is added to the incoming engine air to reduce the cylinder air temperature.

BRIEF DESCRIPTION OF THE DRAWINGS

Reference will now be made to the attached drawings, when read in combination with the following detailed description, wherein like reference numerals refer to like parts throughout the several views, and in which:

FIG. 5 is an illustration of a schematic arrangement with the oscillating connecting rod of FIG. 1 line positioned for low compression;

Referring now to FIG. 6, a similar schematic illustration to FIG. 5 is again shown for a high compression line positioned for high compression; and FIG. 7 is a control schematic for automatically establishing both low and high compression ratios, as determined by the piston position within the combustion chamber.

DETAILED DESCRIPTION OF THE PREFERRED EMBODIMENTS

Figure 1:
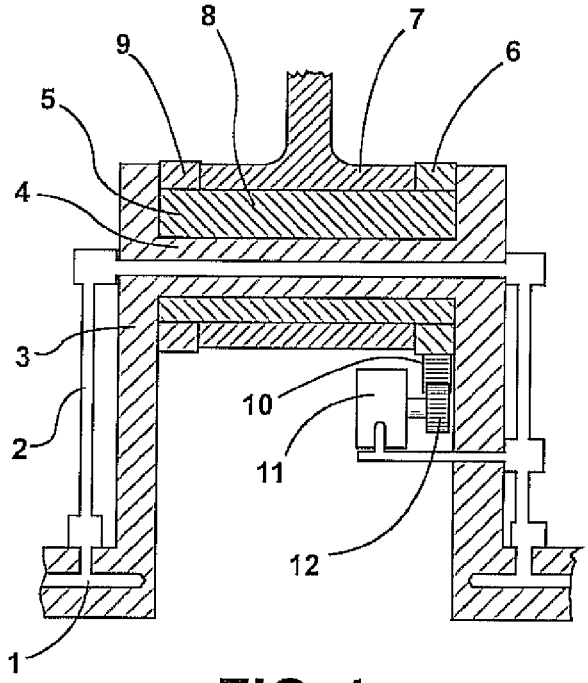
Referring now to FIG. 1, a cutaway illustration is shown of a crank shaft and gear assembly in a high compression operating condition.

Referring now to FIG. 1, a cutaway illustration is shown of a crank shaft and gear assembly in a high compression operating condition. A crank shaft is shown at 1 and includes crank arms 3 which are connected by a shaft 4. A connecting rod 7 with bearing 8 is illustrated in a high compression mode level 24 (see FIGS. 5 and 6) and oscillates on the outside diameter of a sleeve 5 with the inside diameter supported by the crank cross shaft 4.

A ring gear 6, affixed to the sleeve 5, meshes with a pinion gear 12 driven by a hydraulic motor 11. A ring 9, located on the opposite side and part of a sleeve assembly 22 (see FIGS. 5 and 6) provides flanges to secure two associated half sleeves. The pinion gear 12 is driven by a hydraulic motor and supplied by pressurized oil through tubes 2, these extending from a channel in the crank shaft 1.

Figure 2:
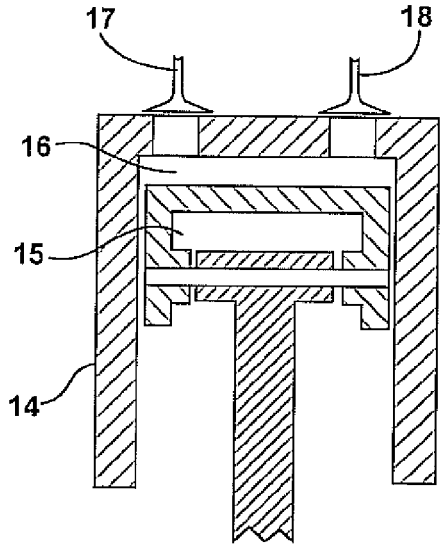
FIG. 2 is a sectional cutaway view of a piston and cylinder arrangement associated with the assembly of FIG. 1 and in a high compression condition.
Figure 3:
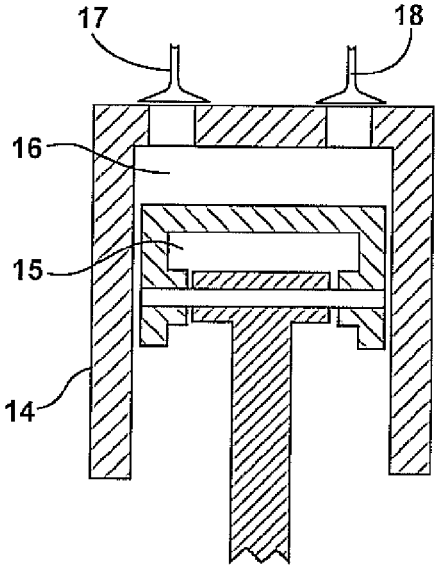
FIG. 3 is a similar illustration to that shown in FIG. 2 and showing the piston located at a low compression position within the cylinder.
Figure 4:
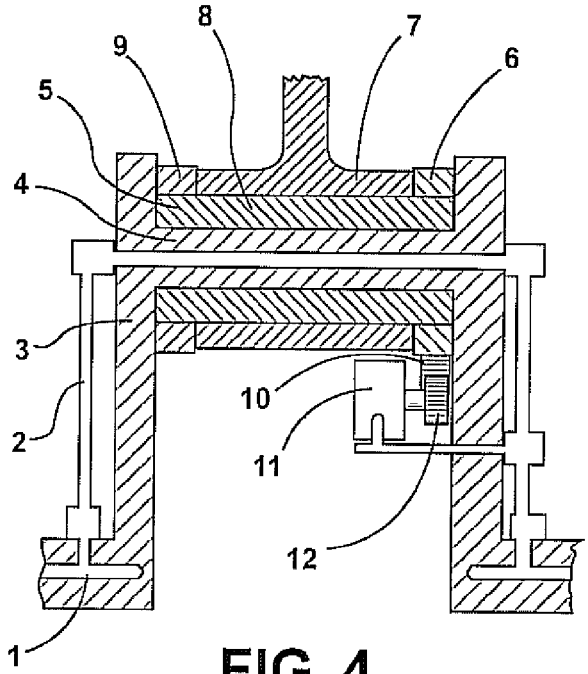
FIG. 4 is a similar illustration of the assembly of FIG. 1 and corresponding to the piston established in the low compression position.

FIG. 2 is a sectional cutaway view of a piston and cylinder arrangement associated with the assembly of FIG. 1 and in a high compression condition 23 (as again referenced in schematic in each of FIGS. 5 and 6). Specifically, a cylinder 14 houses a piston 15 which defines an upper combustion chamber 16. Also included are valves associated with an air inlet 17 and an exhaust 18. FIG. 3 is a similar illustration to that shown in FIG. 2 and showing the piston 15 located at a low compression position 24 within the cylinder 14. Referring now to FIG. 4, a similar illustration of the assembly of FIG. 1 is shown and corresponds to the piston established in the low compression 23 position.

FIG. 5 is an illustration of a schematic arrangement corresponding with the connecting rod 7 (FIG. 1) line positioned for low compression 23. A sleeve 22 is provided with an off center internal diameter affixed with an end ring gear 21, this meshing with a pinion gear 20 (see also at 12 in FIG. 1) for 120 degree rotation. Referring now to FIG. 6, a similar schematic illustration to FIG. 5 is again shown for a high compression line 24.

FIG. 7 illustrates the control diagram of a vehicle operating in an automatic mode requiring a voltage supply 64, 65. The engine coolant water temperature raises above 120° F. contact 44 closes which is in series with the spray water temperature switch 43 contact which closes above 120° F. and float switch 42 is closed with adequate spray water level water relay 41 is energized contact 45 closes and energizes the spray water pump 46. When the engine coolant water is above 130° F. the vapor pump relay 49 is energized along with time relay 52 controlling eccentric 6 rotation time relay 49 also closes contact 50 energizing the oil pump 51. When the timer 52 times out contact 48 opens and shuts off pump motor 51. This completes the 180 degree rotation of the eccentric sleeve 6. The engine now is operating under high compression.

When the vehicle is shut off a second line voltage 61-62 is deenergized when the main engine oil pressure pump switch closes contact 57 and when the driver side door is opened a limited switch 55 closes timer 60 is energized and is locked in by contact 56 for a limited time the oil pump is reenergized through contact 59 reversing the eccentric sleeve 6 rotates 180 degrees to its original downtime position. The engine now is returned to low compression.

An associated method is also disclosed for injecting a water based fluid in the incoming air flow of an Otto cycle engine and can include a second fuel additive assisting in modifying combustion temperature in response to climate variations and exhibits a relatively small volume compared to total fuel component, and such as which normally includes a standard octane rated fuel and ethanol or other fuels. The composition of the fluid additive includes a water emulsion with a thin water skin (micelles) under 1 micron (such as approximately 0.2 microns in one variant) in thickness.

Upon the fluid emulsion being injected during pressurizing the film of water, it will instantly vaporize, thereby reducing the required temperature of compression and preventing pre-ignition. Upon the piston achieving a top dead center position and dwelling with the standard fuel injected, pre-ignition will not occur. Other liquid evaporation processes can also be used, such as water by itself under reduced surface tension and with high pressure can be vaporized into a fine mist, thereby mimicking the physical properties of a gas. The above can be employed for reducing a surface tension of the fluid by absorbing engine waste heat and injecting the same under high pressure, creating a finely disbursed fog and expanding to a gas during compression.

Having described my invention, other and additional preferred embodiments will become apparent to those skilled in the art to which it pertains, and without deviation from the scope of the appended claims.

I claim:

1. An apparatus for an "Otto" engine for increasing engine efficiency by operating with two compression ratios, comprising;

the engine using a standard compression ratio during engine warming period, the engine automatically transferring to a higher ratio after the engine has reached a higher temperature level;

a connecting rod journal supported on an eccentric sleeve riding on a crank shaft pin and hydraulically activated to rotate 180 degrees with its affixed ring gear meshing with a pinion gear keyed to a hydraulic motor located on the crank shaft arm and supplied by a hydraulic pump supplied through and on the crank shaft;

a water pump generating a vapor mixing with an incoming engine air to prevent pre-ignition within each cylinder of the engine.

2. The apparatus as described in claim 1, further comprising activation of the water spray and oil supply pumps by temperature switches immersed in an engine coolant water.

3. The apparatus as described in claim 1, further comprising shutdown of the operating system by an engine oil pump switch and a limit switch located on a driver side door.

4. A method of operating an Otto cycle engine with two compression ratios to reach a higher combustion chamber pressure, comprising the steps of;

injecting a water spray in an engine air intake under starting conditions and in order to reduce a temperature of compression;

advancing the connecting rod by rotating an eccentric sleeve on a crank shaft pin to reduce a combustion chamber volume and in response to sensing a higher engine coolant temperature.

5. The method of claim 4, further comprising the step of injecting water vapor in an engine intake air when the engine cooling water is above 120°.

6. The method of claim 4, further comprising the step of raising the connecting rod when the engine coolant water temperature is above 130°.

7. The method of claim 4, further comprising the step of resetting the connecting rod by employing a second electrical circuit to activate a timer when and if engine oil pressure switch reads zero and a limit switch further closes when a driver side door is opened.

* * * * *